US005566401A

United States Patent [19]

Kishi et al.

[11] Patent Number: 5,566,401

[45] Date of Patent: Oct. 22, 1996

[54] CLEANING MECHANISM OF A STOOL

[75] Inventors: Mitsuhiro Kishi, Ashikaga; Toyohiko Sunaoka, Tokyo; Mikio Shimoyama, Ashikaga, all of Japan

[73] Assignee: Nikken Corporation, Tokyo, Japan

[21] Appl. No.: 359,476

[22] Filed: Dec. 20, 1994

[30] Foreign Application Priority Data

Dec. 21, 1993 [JP] Japan ..... 5-345326

[51] Int. Cl.[6] ..... E03D 9/00

[52] U.S. Cl. ..... 4/300; 4/232; 4/459

[58] Field of Search ..... 4/222, 223, 232, 4/300, 309, 340, 341, 342, 459, 662, DIG. 10, 321

[56] References Cited

U.S. PATENT DOCUMENTS 3,289,214 12/1966 Corliss ..... 4/321
3,383,710 5/1968 Sumner ..... 4/300 X
3,585,649 6/1971 Miya ..... 4/459 X
3,843,976 10/1974 Miya et al. ..... 4/300

FOREIGN PATENT DOCUMENTS 4011133 1/1992 Japan ..... 4/662

*Primary Examiner*—Robert M. Fetsuga
*Attorney, Agent, or Firm*—Flynn, Thiel, Boutell & Tanis, P.C.

[57] ABSTRACT

Raw sewage, toilet paper or foreign matter is prevented from being stuck to an inner bowl of a stool by air bubbles. A cleaning mechanism of the stool comprises an outer cover which has an upper opening and can store cleaning liquid therein, an inner bowl accommodated inside the outer cover and a ring-shaped upper cover which contacts the upper end of the outer cover. An upper end peripheral edge of the inner bowl is spaced from the outer cover and upper cover and air is spouted from air discharge bodies provided at the bottom of the outer cover so that the air discharge bodies generate air bubbles which agitate the cleaning liquid so as to generate bubbles which stick to the entire surface of the inner wall of the inner bowl.

19 Claims, 12 Drawing Sheets

CLEANING MECHANISM OF A STOOL

FIELD OF THE INVENTION

The present invention relates to a cleaning mechanism of a toilet stool for preventing raw sewage or foreign matter such as paper from being stuck to an inner wall of an inner bowl of a stool and for cleaning the stool.

BACKGROUND OF THE INVENTION

In a toilet installed in a house, family office or the like, a flush toilet which is connected to a water supply pipe and a sewage pipe is the mainstream for environmental utility and improvement of hygiene. The flush toilet has a reservoir tank which temporarily stores water and a stool which is connected to the reservoir tank. When a user discharges raw sewage into the stool, the raw sewage can be forced to flow into the sewage pipe by discharging water from the reservoir tank. When the water supply pipe is connected to the reservoir tank, the raw sewage can be forcibly discharged to the sewage pipe, thereby facilitating the disposal of the raw sewage.

In the disposal of raw sewage in the flush toilet, it is possible to discharge a large amount of water from the reservoir tank, thereby discharging a raw sewage and at the same time cleaning the inner wall of the stool. As mentioned above, in the flush toilet, the discharge of the raw sewage and the cleaning of the stool can be performed at the same time so that the flush toilet can be easily controlled. Even if the inner wall of the flush toilet is dirty, dirt can be cleaned by a brush, etc. by flushing water from the reservoir tank since the water is always supplied from the water supply pipe to the reservoir tank. As a result, the cleaning of the stool can be easily accomplished if there is a supply of water from the water supply pipe even if the cleaning is manually performed.

However, there are many houses having no flush toilet, and such toilet connects to a purifying tank or a night soil tank since water supply and sewage pipes are not installed. In such a toilet, self-cleaning cannot be performed since tap water is not supplied to the toilet. Furthermore, since the purifying or night soil tank is connected to the stool, even if the large amount of tap water is flushed into the stool, the tap water is forced to flow into the purifying tank or night soil tank, and hence the dirt on the stool cannot be flushed by the tap water.

In the toilet which is installed in a transportation facility such as vessels, airplanes or trains, a reservoir tank fixed to the transportation facility and a stool are connected to each other and raw sewage discharged to the stool is accommodated in the reservoir tank until the transportation facility reaches its destination. The reservoir tank is limited in its size because the capacity thereof is designed to merely accommodate the raw sewage in view of the structural demand of the transportation facility. Under the circumstances, a large amount of cleaning water cannot be flushed into the stool. In such a stool, the dirt stuck to the stool cannot be satisfactorily flushed using the cleaning water.

In a temporary toilet which has been temporarily installed in a disaster area or a construction site, the reservoir tank is also limited in its capacity. It has been difficult to employ the structure for flushing the raw sewage and dirt using the cleaning water such as in a flush toilet. Accordingly, it has been difficult to discharge a large amount of water into the stool so as to clean the stool even if the stool is dirty.

Accordingly, in the cleaning of toilet stools of the aforementioned types, the stool is normally cleaned manually, the cleaning operation is unhygienic, and hence modernization thereof has been required.

Under the circumstances, there has been proposed a stool wherein the inner wall of the stool is covered with bubbles which are stuck thereto and the raw sewage is dropped on the bubbles. In such a stool, the raw sewage does not contact directly the stool and dirt is not generated on the inner wall of the stool since the raw sewage is discharged together with the bubbles so that the stool is always kept clean. There have also been proposed cleaning mechanisms for generating bubbles to prevent the stool from becoming dirty.

However, in the stool having a cleaning mechanism for generating bubbles, the generated bubbles are jetted from a discharge port formed in part of the stool so that the bubbles are stuck merely to a central portion or near a central portion of the stool so that the bubbles cannot be stuck to the periphery of the inner wall. Accordingly, raw sewage is not prevented from being stuck to the peripheral surface of the inner wall of the stool. Further, in the stool having such cleaning mechanism using bubbles, the raw sewage can be dropped into a drain or sewage pipe by the bubbles, but toilet paper or other foreign matter which has been used cannot be flushed. Accordingly, if toilet paper or foreign matter is stuck to the stool, it must first be moved manually using a brush, etc. and then removed from the stool.

The present invention, which has been made so as to overcome the aforementioned problems, injects air bubbles into the cleaning water so as to generate bubbles and then flows the thus generated bubbles inside the entire inner wall of the bowl of a stool, thereby covering the inner bowl by the bubbles. When the bubbles are stuck to the entire inner wall of the stool, the raw sewage discharged into the stool is always covered with the bubbles, thereby preventing the raw sewage from being stuck to the stool. Furthermore, even if toilet paper or foreign matter is dropped onto the inner bowl, cleaning water is forcibly flushed after the discharge of the raw sewage so as to discharge the toilet paper or foreign matter into the drain or sewage pipe, thereby dispensing with a further cleaning operation after the discharge of the raw sewage.

The present invention is to provide a cleaning mechanism for a stool which comprises an outer cover having a bottom part and an upper opening, an inner bowl which is accommodated inside the outer cover for receiving raw sewage and spaced from the outer cover so as not to contact the outer cover, a substantially frame-shaped upper cover having a periphery which is brought into contact with an upper end of the outer cover, a lower surface which is spaced from an upper end peripheral edge of the inner bowl and a central introduction hole through which raw sewage is introduced into the inner bowl, wherein cleaning water is interposed in a space between the outer cover and the inner bowl, the cleaning water being mixed with a foaming material, and air discharge bodies provided inside the bottom part of the outer cover for receiving air supplied from outside and spouting the air.

According to the present invention, the stool has an outer casing comprising the outer cover and upper cover the inner bowl is accommodated between the outer and upper covers for receiving the raw sewage. A large evacuation opening is defined on the central portion of the upper cover for exposing the inner wall of the inner bowl and the inner side of the ring-shaped periphery of the upper cover is spaced from an upper end peripheral edge of the inner bowl. Cleaning water containing a foaming material such as a surface active agent is reserved between the outer cover and inner bowl. If air is introduced under the cleaning water, bubbles are generated in the cleaning water so that the bubbles filled the region between the outer cover and inner bowl. When the bubbles rise, they flow from the upper end peripheral edge of the inner bowl toward the inner wall of the inner bowl so that the entire inner wall of the inner bowl is covered with the bubbles.

In the state where the bubbles are stuck to the entire inner wall of the inner bowl, when the raw sewage is dropped from the large evacuation opening into the inner bowl, the raw sewage is covered with the bubbles so that it does not contact the inner wall of the inner bowl. When the raw sewage has been discharged, the cleaning water is jetted from an ejector along the inner peripheral surface of the inner bowl, and the raw sewage can be dropped together with the bubbles. At this time, the raw sewage, toilet paper and foreign matter are floated by the bubbles and can be slid along the inner bowl and dropped into the drain or sewage pipe because of the high fluidity. In such manner, the raw sewage does not contact the inner wall of the inner bowl and dirt does not stick thereto. Accordingly, the stool is always kept clean, which dispenses with the manual cleaning operation.

DETAILED DESCRIPTION

First Embodiment (FIGS. 1 to 8):

A cleaning mechanism of a stool according to a first embodiment of the invention will now be described with reference to FIGS. 1 to 8.

According to the first embodiment, the cleaning mechanism of a stool is provided in a temporary toilet 11. The temporary toilet 11 per se is freely movable and can be temporarily used at a disaster area, construction site, festival, meeting, etc.

Figure 1:
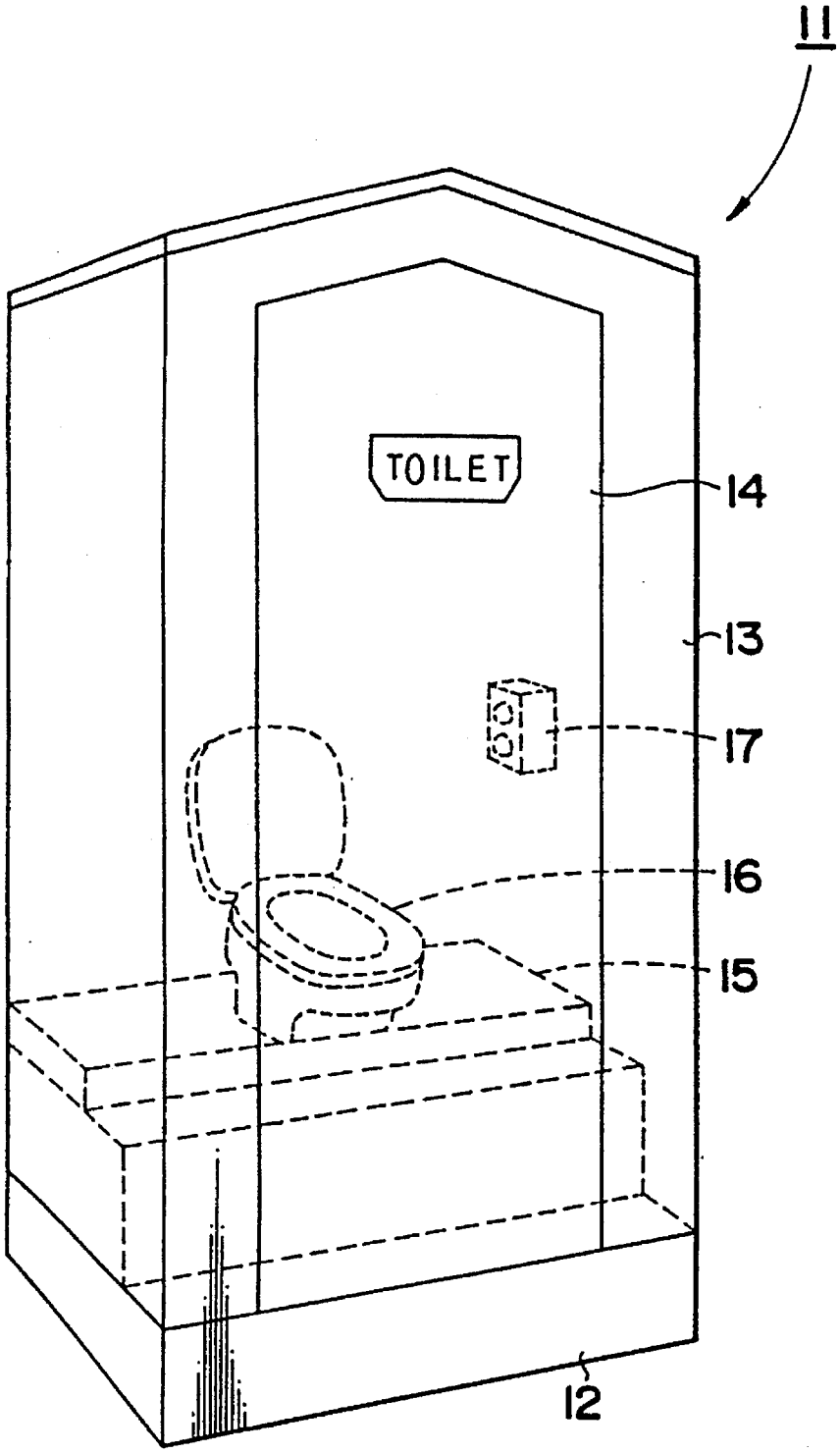
FIG. 1 is a perspective view of a temporary toilet, such as for use outdoors, to which a stool cleaning mechanism according to a first embodiment of this invention is applied.

FIG. 1 shows the temporary toilet 11. The outer frame of the temporary toilet 11 is made of, e.g. plastic or reinforced synthetic resin and has a cubic boxlike shape. The temporary toilet 11 has a base 12 which can be supported on the ground. The base 12 has a cubit shape and has a roofed house 13 fixed thereto at the upper portion thereof. A door 14 is attached to the front of the house 13 and opens forward thereof so that a user can go in and out from the house 13.

The temporary toilet 11 has inside thereof a raw sewage disposal apparatus 15 which is fixed to the upper portion of the base 12. In the present embodiment, the raw sewage disposal apparatus 15 is exemplified as a self-disposal apparatus for drying and disposing of the raw sewage but it may be replaced by a reservoir tank for merely holding the raw sewage therein. A western-style stool 16 is fixed to an upper portion of the raw sewage disposal apparatus 15 and the user using the temporary toilet 11 can utilize the stool 16 for discharging raw sewage.

A detector 17 is fixed to an inner wall of the house 13 beside the stool 16 for judging the use of the stool 16 by the user. The detector 17 may be one which can judge as to whether the user sits on the stool 16 by the presence or non-presence reflection of infrared rays from the user's body. The detector 17 may also be one which can judge as to whether the user is inside the house 13 based on reflection of supersonic waves which are emitted thereby. The detector 17 may also be one which can judge as to whether the user is present inside the house 13 by variation of static electricity.

Figure 2:
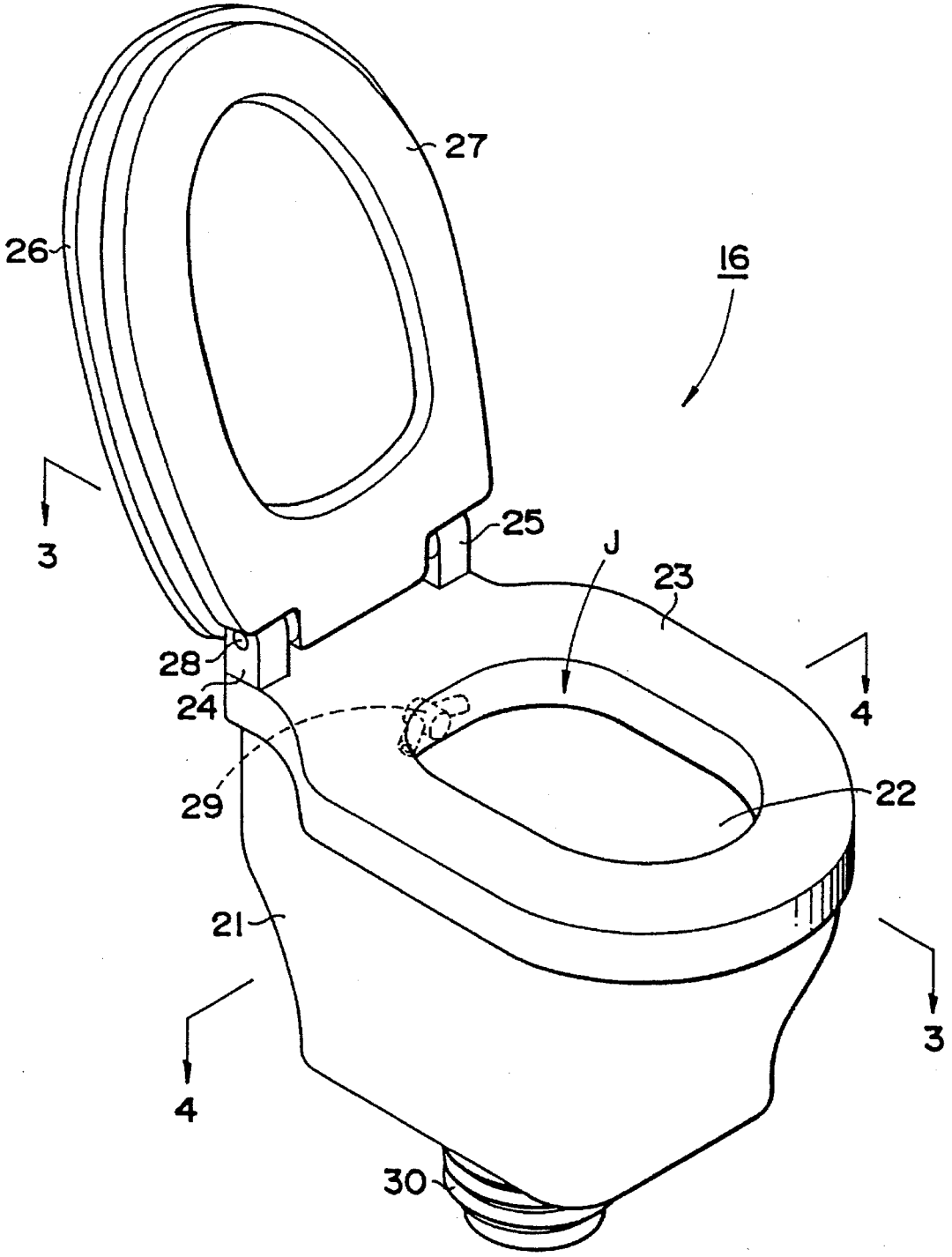
FIG. 2 is a perspective view of an external appearance of a western-style stool provided with the cleaning mechanism of FIG. 1.

FIG. 2 is a perspective view of the stool 16, shown removed from the raw sewage disposal apparatus 15, for explaining the structure of the cleaning mechanism of the stool.

The stool 16 comprises an outer shell or cover 21, an upper cover 23 and an inner bowl 22 disposed between covers 21 and 23. The outer cover 21, inner bowl 22 and upper cover 23 are each integrally formed of a material capable of easily forming a curved surface such as reinforced plastic, FRP.

The outer cover 21 has a closed bottom for accommodating liquid therein and has a boxlike shape with the upper portion thereof being largely opened. The outer cover 21 has an external shape which is gradually enlarged from the bottom portion to the upper portion like a bucket shape. An inner bowl 22 is accommodated inside the outer cover 21 for receiving raw sewage which is discharged from the human body. The inner bowl 22 has an opened upper end which is substantially circular and it is substantially hemispherical and is throttled in external shape in the downward direction. The lower portion of the inner bowl 22 is connected to a joint 30 through which the raw sewage or the cleaning water is flushed. The upper end surface of the outer cover 21 is largely opened at the center thereof to form an introduction hole J through which the raw sewage is introduced and it is engaged with the upper cover 23 which is substantially oval as a whole. An external appearance of the upper cover 23 is substantially the same as that of the outer cover 21 and the inner diameter of the introduction hole J is slightly smaller than the upper opening of the inner bowl 22. Viewing from the outside, the inside of the outer cover 21 seems as if it were covered with the upper cover 23.

Shaft supporting pieces 24 and 25 are fixed to the left and right sides of the rear portion (left side in FIG. 2) of the upper cover 23 and they are directed upward. A lid 26 and a seat 27 are respectively inserted between the shaft supporting pieces 24 and 25 and the lid 26 and seat 27 are held by a hinge pin 28 which penetrates between the shaft supporting pieces 24 and 25 so as to be turned about the pin 28. That is, lid 26 and seat 27 can be freely turned by the pin 28 so that only the seat 27 may be placed on the upper surface of the upper cover 23 or both the lid 26 and seat 27 may be placed on the upper surface of the upper cover 23 at the same time, as is conventional. An ejector 29 which is close to the seat 27 (left side in FIG. 2) is fixed to the upper portion of the inner wall of the inner bowl 22 for jetting cleaning water.

Figure 3:
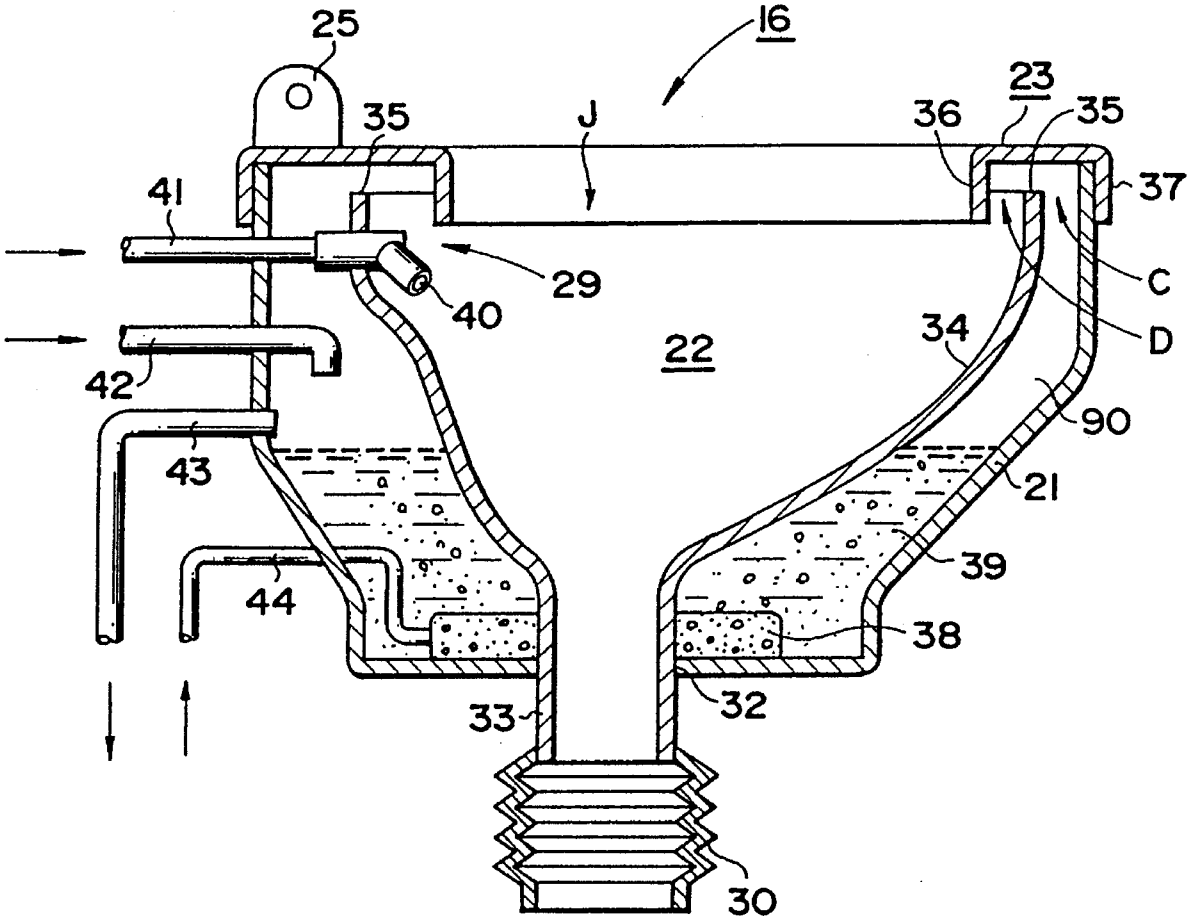
FIG. 3 is a cross-sectional view taken along line 3—3 of FIG. 2.
Figure 4:
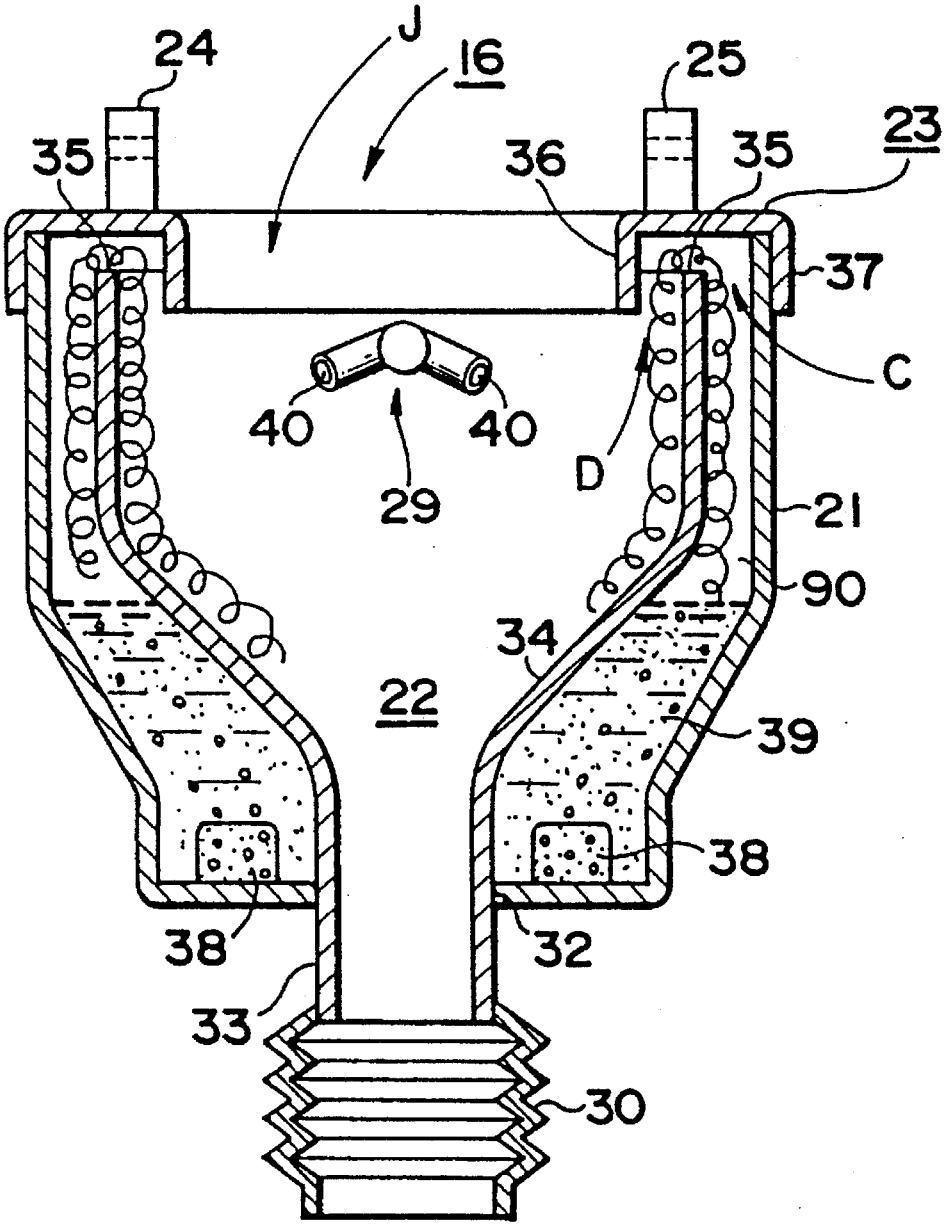
FIG. 4 is a cross-sectional view taken along line 4—4 of FIG. 2.
Figure 5:
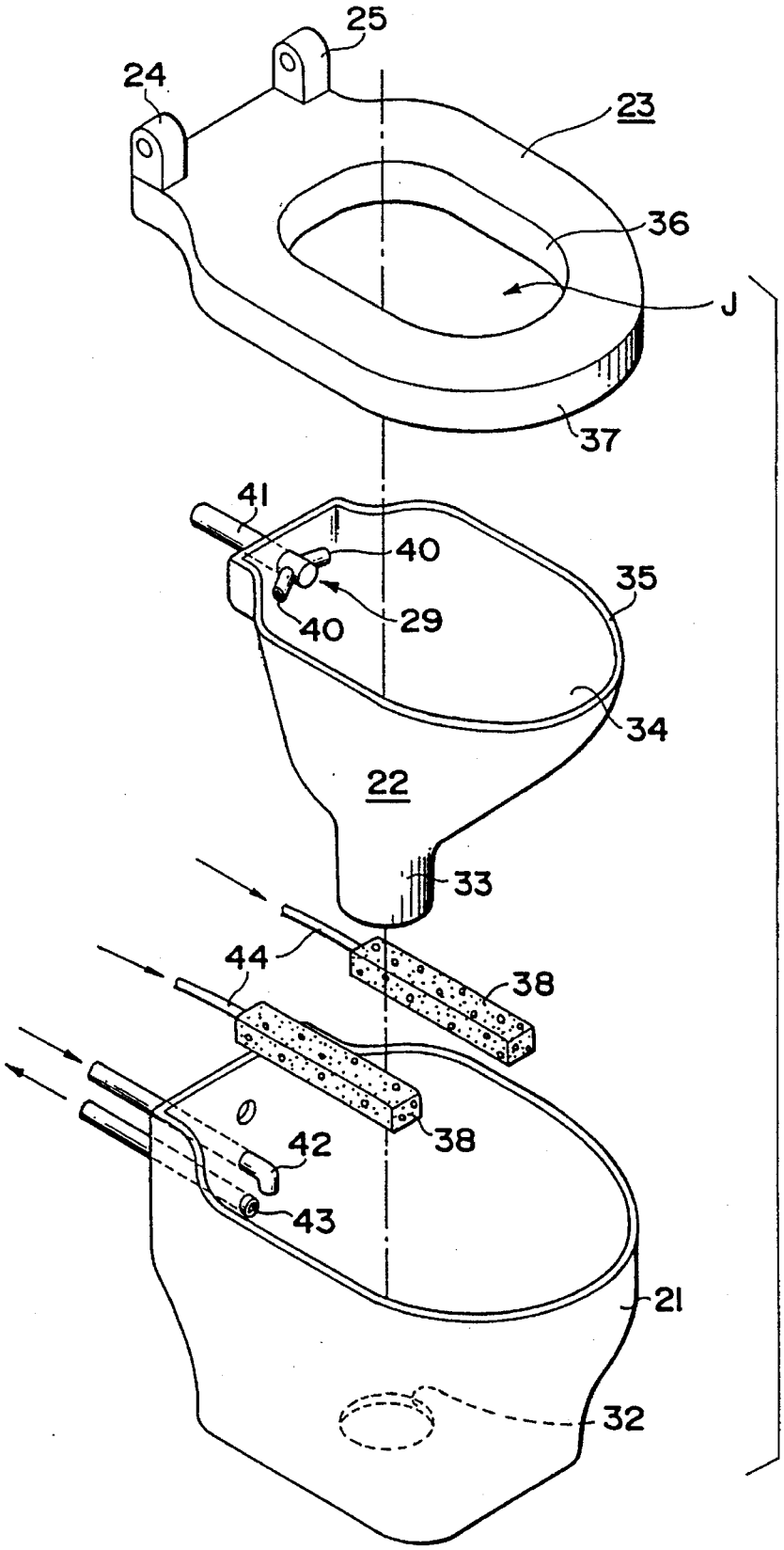
FIG. 5 is an exploded perspective view showing main constituents of the stool of FIG. 2.

As shown in FIGS. 3–5, the outer cover 21 has a bottom wall with a circular opening or port 32 at the center thereof. The outer cover 21 is gradually enlarged from the bottom portion to the upper portion thereof in its outward appearance and the upper end thereof has a horizontal opening end. The upper cover 23 covers the upper opening of the outer cover 21. The large introduction hole J is defined in the center of the upper cover 23, and an inner wall 36 and an outer wall 37 are formed at the inner and outer peripheries of the oval ring-shaped upper cover 23 and project downwardly to form annular rims. The oval upper cover 23 thus has a substantially U-shaped cross section. An inner peripheral shape of the outer wall 37 is the same as the outer peripheral shape of the outer cover 21 at the upper end of the outer cover 21. When the upper cover 23 covers the upper end of the outer cover 21, the inner surface of the outer wall 37 is brought into contact with the outer periphery of the outer cover 21 so as to provide the outward appearance of a western-style stool wherein the outer cover 21 is integrated with the upper cover 23.

The inner bowl 22 is accommodated inside the outer cover 21 and it is cut horizontally at the upper end thereof so as to form a hemispherical shape. A water receiving portion 34 having a sloping curved surface is formed on the inner bowl 22 and it is throttled from the upper end toward the lower side thereof. A discharge pipe 33 is formed at the lower end which is continuous from the water receiving portion 34. Since the water receiving portion 34 and the discharge pipe 33 form a continuous surface, the raw sewage can be dropped downward through the continuous surface due to its own weight. The discharge pipe 33 is inserted through the opening 32 and the lower end thereof protrudes downward from the lower surface of the outer cover 21. Adhesive or seal agent fills the gap between the opening 32 and the discharge pipe 33 to prevent liquid leakage.

Air discharge bodies 38 which are formed as rectangular sponges are fixed adjacent opposite sides of the discharge pipe 33 at the bottom surface of the outer cover 21 adjacent opposite sides of the discharge pipe 33 so as to discharge air as fine air bubbles. Cleaning liquid 39 comprising a foaming material such as a surface active agent which is mixed with water is reserved in a substantially doughnut-shaped space or chamber 90 defined between the outer cover 21 and the inner bowl 22. As ingredient of the cleaning liquid 39, it is preferable to have a property which is easily bubbled when the cleaning liquid such as tap water is mixed with a surface active agent and air. As materials of the surface active agent, there are polyoxyethylene, alkyl aryl ether, nonyl phenyl ether, and a combination thereof. They may be benzal chloride conium or raw material of soap. The surface active agent is preferable to have wetability, permeability, foaming property, detergency property, emulsifying property and antistatic property. As the liquid with which the surface active agent is mixed, it may be chemicals or detergent for cleaning flatware, stool or a floor which is generally used in a house or the like. According to the present embodiment, the foaming property of the surface active agent is mainly utilized.

The upper end of the inner bowl 22 is cut horizontally and the thus cut upper end peripheral edge 35 is substantially oval as viewed from above, and this upper edge 35 is positioned in the U-shaped space defined between the rims 36 and 37 of the upper cover 23. The upper peripheral edge 35 is slightly spaced from and does not contact the lower surface of the upper cover 23, and hence the inner bowl 22, upper cover 23, inner wall 36 and outer wall 37 form an E-shaped space in cross section. A passage C is formed between the upper end peripheral edge 35 and the inner wall of the outer cover 21 while a passage D is formed between the upper end peripheral edge 35 and the inner wall of the inner rim 36. The inner space 90 of the outer cover 21 and the inside of the inner bowl 22 communicate with each other at the entire periphery of the upper peripheral edge 35 through the E-shaped annular space defined by the upper cover 23.

The ejector 29 is fixed to an upper wall of the inner bowl 22 (left side in FIG. 3). The ejector 29 has a pair of generally oppositely directed nozzles 40, each of which is also directed slightly downward toward the inner periphery of the water receiving portion 34. An ejector pipe 41 is connected to the ejector 29 for supplying the cleaning liquid 39 under pressure.

A supply pipe 42 is fixed to the upper rear portion of the outer cover 21 (left side in FIG. 3) for introducing the cleaning liquid 39 from the outside to the inside of the outer cover 21. Likewise, a discharge pipe 43 is connected to the upper rear portion of the outer cover 21 under the supply pipe 42 for always keeping the liquid level of the cleaning liquid 39 constant. Further, air pipes 44 are inserted into the lower portion of the outer cover 21 for supplying air from the outside. Tip ends of the air pipes 44 are connected to the air discharge bodies 38. The joint 30, which is made of an elastic material such as rubber and has a bellows-shape for allowing the joint 30 to be flexible, is connected to the lower end opening of the discharge pipe 33 and the lower end opening of the joint 30 is connected to the raw sewage disposal apparatus 15 (FIG. 1).

Figure 6:
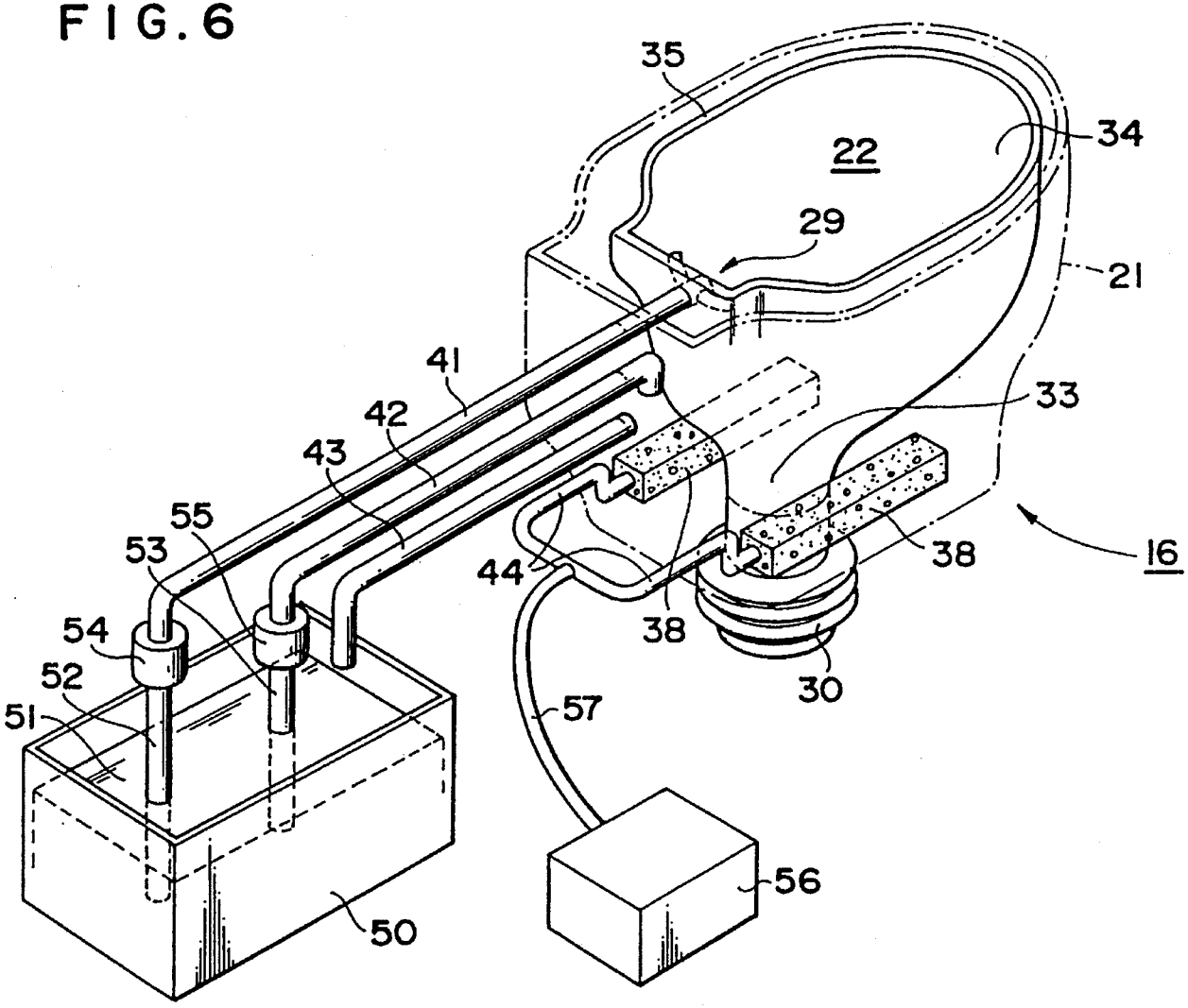
FIG. 6 is a partly cut away perspective view showing a piping system for connecting the stool and other constituents of the stool of FIG. 2.

FIG. 6 is a view showing a piping system for connection between the stool 16 and other constituents. A tank 50 contains cleaning liquid 51 (i.e. water with which a foaming material is mixed) and has a boxlike shape and a closed bottom wall. Suction pipes 52 and 53 extend vertically to adjacent the bottom wall of the liquid tank 50. The cleaning liquid 51 has a high foaming property like the cleaning water 39 and comprises cleaning water and an active surface agent which is mixed therewith.

A liquid pump 54 for sucking the cleaning liquid 51 is connected to the upper end of the suction pipe 52 and a discharge side thereof is connected to a remote end of the ejector pipe 41. A liquid pump 55 for sucking the cleaning liquid is connected to the upper end of the suction pipe 53 and a discharge side thereof is connected to a remote end of the supply pipe 42. The discharge pipe 43 collects the cleaning liquid 39 inside the chamber 90 when the cleaning liquid therein exceeds a fixed liquid level. A remote end of the discharge pipe 43 is positioned directly over the tank 50 for discharge therein.

The air pipes 44 extend outside through the outer cover 21 and connect to an air supply pipe 57 located outside the outer cover 21. The air supply pipe 57 is connected to an air pump 56 which sucks air from the outside and supplies air under pressure through the air supply pipe 57 and air pipes 44 to the air discharge bodies 38.

Figure 7:
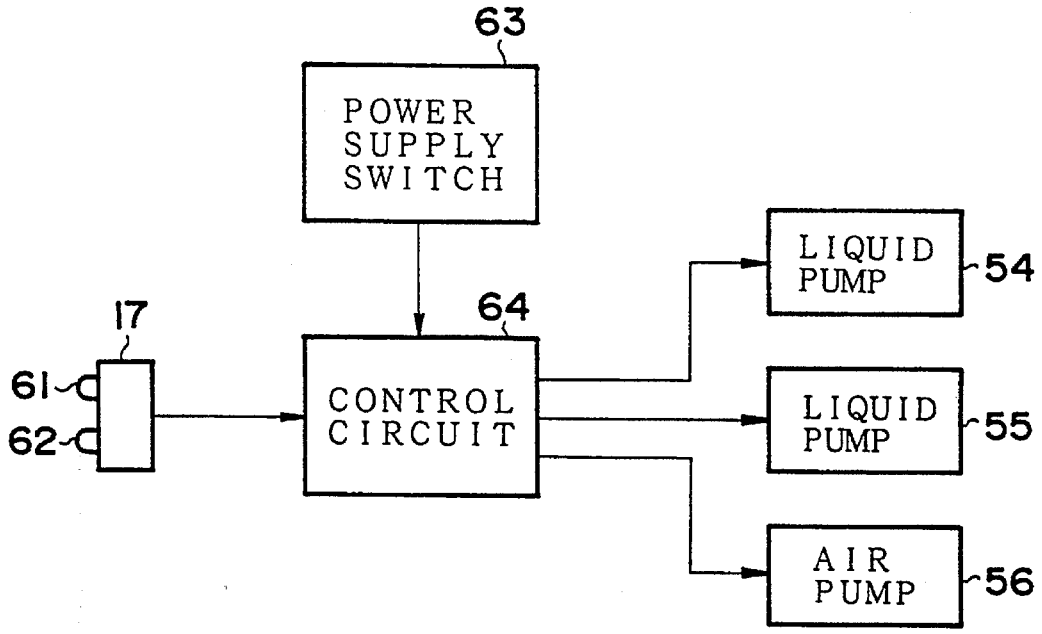
FIG. 7 is a block diagram showing a control system for the cleaning mechanism of the stool of FIG. 2.
Figure 8:
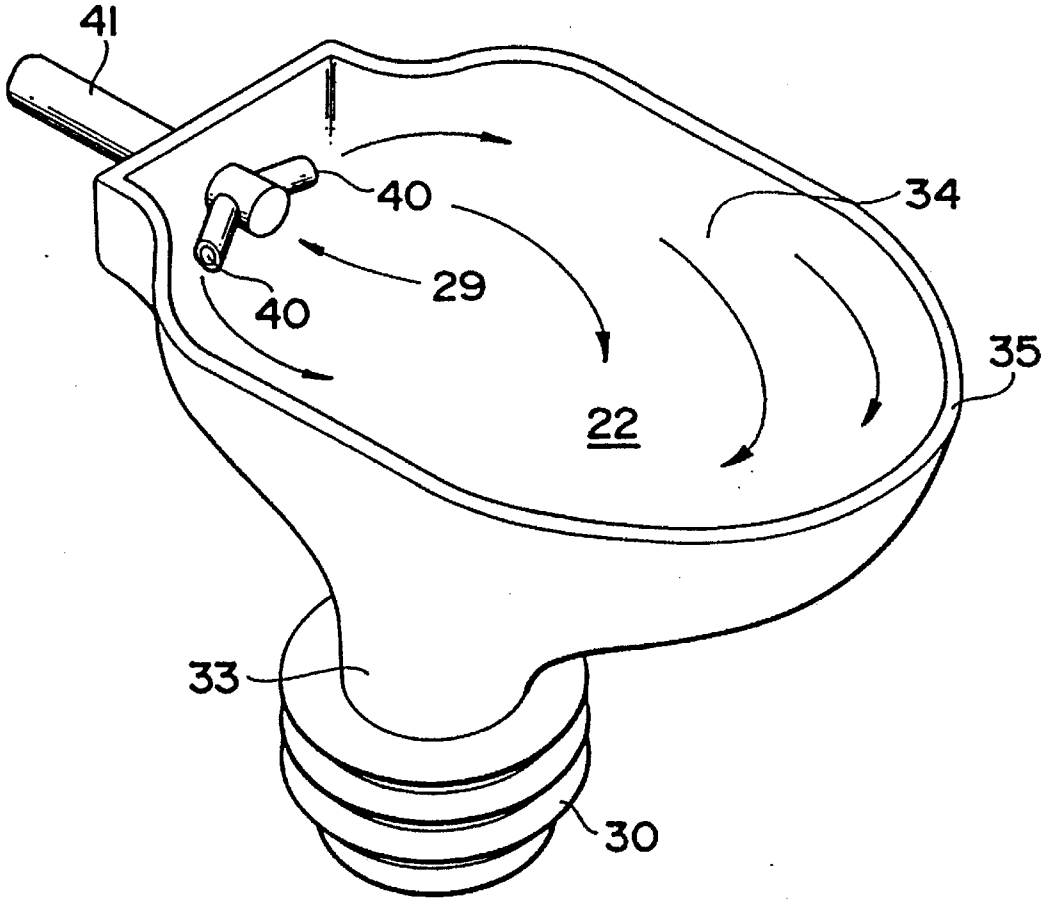
FIG. 8 is a view showing an inner bowl of the stool of FIG. 2 for explaining the flow of cleaning water.
Figure 9:
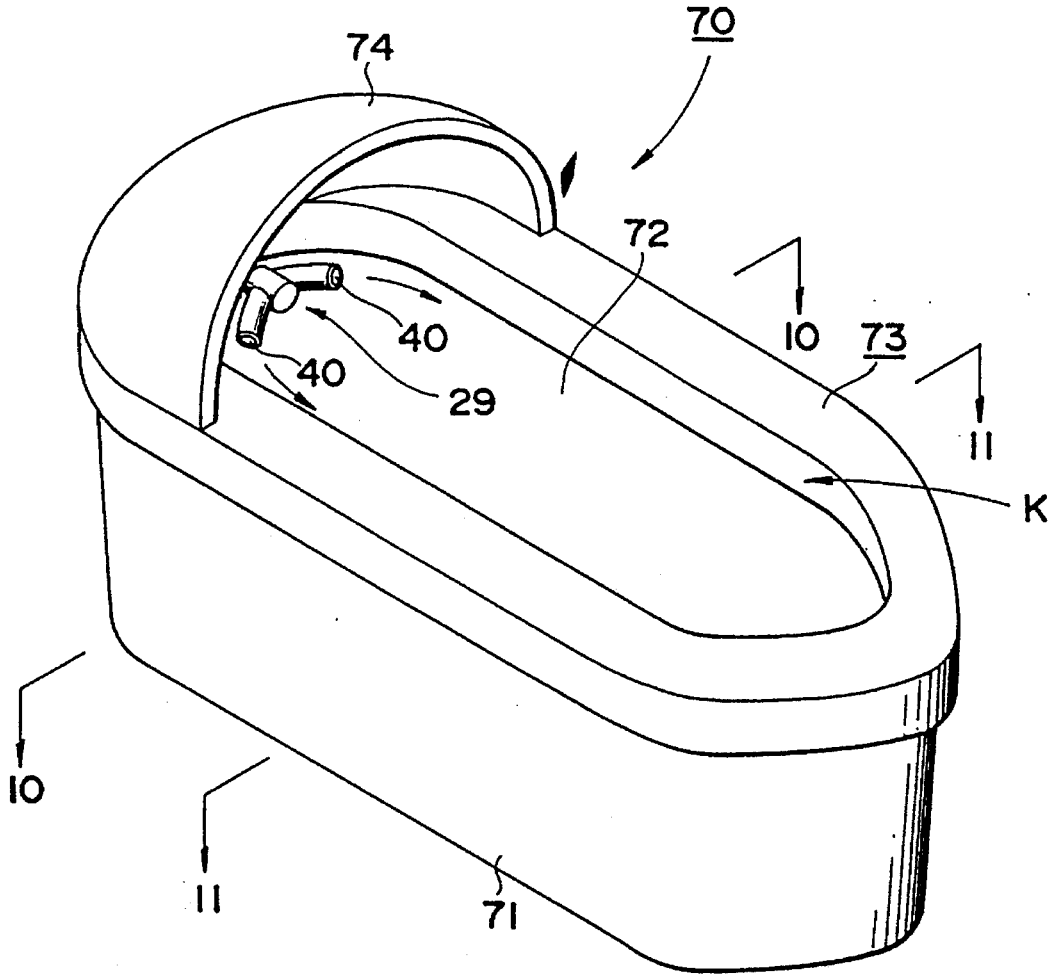
FIG. 9 is a perspective view of an external appearance of a Japanese style stool according to a second embodiment of the invention.

FIG. 7 is a circuit diagram of a control system of the cleaning mechanism of the stool. The detector 17 provided inside the house 13 comprises a light emitter 61 for generating infrared rays and a light receiver 62 for receiving reflected light of the infrared rays emitted by the light emitter 61. A signal issued by the detector 17 is supplied to a control circuit 64 which has a central processing unit (CPU), etc. A power supply switch 63 for operating the cleaning mechanism of the stool is connected to the control circuit 64 and an output of the control circuit 64 is respectively connected to the liquid pumps 54 and 55 and the air pump 56.

The operation of the stool cleaning mechanism will now be described.

The power supply switch 63 is turned on so as to operate the control circuit 64 for allowing the temporary toilet 11 to be in a standby condition. The control circuit 64 operates the liquid pump 55 so that the cleaning liquid 51 in the tank 50 is sucked by the pump 55 through the suction pipe 53 and is discharged into the chamber 90 through the supply pipe 42 if the cleaning liquid in chamber 90 reaches a given liquid level which is normally slightly below the discharge pipe 43. Even if excess cleaning liquid 39 is supplied, it flows through the discharge pipe 43 and is returned to the tank 50. Since the pump 55 is always operated during use of the temporary toilet 11, the supply of cleaning liquid 39 by the supply pipe 42 and the return of the cleaning liquid by the discharge pipe 43 are respectively performed so that the liquid level in chamber 90 is always kept substantially constant.

When using the temporary toilet 11, the user opens the door 14 and enters the house 13. At this time, the infrared rays emitted by the light emitter 61 of the detector 17 are reflected by the user, and the reflected light is received by the light receiver 62. Accordingly, the detector 17 detects the entrance of the user inside the house 13 and issues a judging signal to the control circuit 64.

The control circuit 64 operates the air pump 56 so that it sucks air from outside and supplies the sucked air to the air supply pipe 57 under pressure. The air under pressure is supplied toward the air discharge bodies 38 through the air pipes 44. Since the tip ends of the air pipes 44 are inserted and opened into the air discharge bodies 38, the air under pressure is transmitted through minute gaps in the air discharge bodies 38, which bodies 38 are formed of an open porous material such as or like a sponge. The air is discharged or spouted from the surface of the air discharge bodies 38 as fine or small air bubbles. The fine air bubbles spouted from the air discharge bodies 38 rise to the surface of the cleaning liquid 39 within chamber 90 while stirring or agitating the cleaning liquid 39. As the air bubbles rise to the surface of the cleaning liquid 39, the cleaning liquid 39 is stirred by these air bubbles and bubbled by the foaming material which is dissolved in the water so that the fine bubbles are generated on the surface of the cleaning liquid 39. As a result, such fine bubbles tend to fill the chamber between the inner wall of the outer cover 21 and the outer wall of the inner bowl 22. When the fine bubbles rise successively so as to be heaped up, they reach the upper end of the inner bowl 22 and pass through the passage C and over the upper peripheral edge 35, and then pass downwardly through the passage D and flow onto the inner wall of the water receiving portion 34. Since the passages C and D are annular in shape and surround the upper end peripheral edge 35 of the inner bowl 22, the bubbles which flow downwardly from the entire periphery of the upper end edge 35 uniformly stick to the water receiving portion 34 of the inner bowl 22. When the bubbles are uniformly stuck to the entire area of the water receiving portion 34, the inner wall of the water receiving portion 34 is surrounded by the fine bubbles as viewed from above.

When the user discharge raw sewage toward the inner bowl 22 through the introduction hole J of the upper cover 23 in the state where the entire area of the water receiving portion 34 is surrounded by the bubbles, the discharged raw sewage is dropped onto the bubbles which have been previously stuck to the entire area of the water receiving portion 34. Accordingly, the discharged raw sewage is wrapped in the bubbles. Since the bubbles per se have lubricity, the raw sewage slides down the water receiving portion 34 due to its weight and flows into the discharge pipe 33, and then passes through the joint 30 and finally flows into the raw sewage disposal apparatus 15. The flow of the raw sewage is based on the inner shape of the water receiving portion 34 since the water receiving portion 34 is formed at a given inclination angle onto which the raw sewage slides.

When the user finishes use of the temporary toilet 11, he opens the door 14 and exists the house 13. The infrared rays emitted by the light emitter 61 of the detector 17 are not reflected by the user, and hence the light receiver 62 does not receive the reflected light, so that the detector 17 judges that the user has existed the house 13. The judging signal issued by the detector 17 is supplied to the control circuit 64. The control circuit 64 judges the completion of the discharge of the raw sewage by the user and successively starts an automatic cleaning operation, upon reception of the judging signal from the detector 17.

Then, the control circuit 64 stops the operation of the air pump 56 so that the supply of pressurized air, to the air discharge bodies 38 is stopped, whereby generation and discharge of fine air bubbles by the cleaning liquid 39 is stopped. Since the pump 55 is always operated so as to continuously supply the cleaning liquid 51 to the chamber 90 during the operation of the control circuit 64, the level of the cleaning liquid 39 in the outer cover 21 does not significantly vary.

At the same time, the control circuit 64 operates the liquid pump 54 so that the cleaning liquid 51 inside tank 50 is sucked through the suction pipe 52 and is supplied under pressure through the ejector pipe 41 to the ejector 29 where it is jetted by the nozzles 40 under strong force. The cleaning liquid jetted from the nozzles 40 flows along the curved inner surface of the water receiving portion 34 of the inner bowl 22 and falls down. The flowing direction of the cleaning liquid jetted from the nozzles 40 is shown by arrows in FIG. 8 where the cleaning liquid flows downward while it flows around on the inner peripheral surface of the water receiving portion 34 so as to permit the raw sewage together with bubbles stuck to the water receiving portion 34 to flush down toward the joint 30.

The toilet paper or foreign matter which is used by the user may stick to the water receiving portion 34 of the inner bowl 22, as by absorbing the bubbles including any associated cleaning liquid. However, when the cleaning liquid is jetted from the nozzles 40, the toilet paper or foreign matter falls down together with the raw sewage due to the jetting force from the nozzles 40 and is flushed down through the discharge pipe 33 into the raw sewage disposal apparatus 15.

After the control circuit 64 operates the liquid pump 54 so as to jet the cleaning liquid from the nozzles 40 to perform the cleaning operation, it stops the operation of the liquid pump 54 by a timer integrated therein after a given time lapses. Thereafter, the control circuit 64 returns to a standby state and temporarily stops the operation of the liquid pump 54 until a next user uses the temporary toilet 11.

Second Embodiment (FIGS. 9 to 12):

Stool 70 is a known type, i.e. a so-called train type or Japanese type, and it is installed inside the temporary toilet 11. Elements which are the same as those of the first embodiment are denoted by the same numerals and an explanation thereof is omitted.

An outer casing of the stool 70 comprises an outer cover 71 and an upper cover 73. An inner bowl 72 for receiving the raw sewage discharged by the user is accommodated between the outer cover 71 and the inside of the upper cover 73. The outer cover 71, inner bowl 72 and upper cover 73 are each integrally formed of a material capable of easily forming a curved surface such as reinforced plastic, FRP.

The outer cover 71 has an oval bottom part and can store liquid therein and an upper opening. The oval upper cover 73 covers the outer cover 71, while the outer cover 71 and upper cover 73 are fixed to each other by an adhesive agent, etc. The upper cover 73 is ring-shaped and has an oval introduction hole K at the central portion thereof. The inner bowl 72 is oval in its entire shape and accommodated inside the outer cover 71 for receiving the raw sewage. The inner bowl 72 is curved at the front and rear portions thereof and flat at the central portion thereof. A peripheral edge on the upper end of the inner bowl 72 is covered by a flat portion of the upper cover 73. A frontal screen 74, which has a halved bowl-shape, is fixed to the front side of the upper cover 73. The ejector 29 is fixed to the wall surface of the inner bowl 72 at the front side thereof (left side in FIG. 9) under the frontal screen 74. The ejector 29 has a pair of nozzles 40 at the left and right sides thereof which are inclined aslant for jetting the cleaning liquid.

Figure 10:
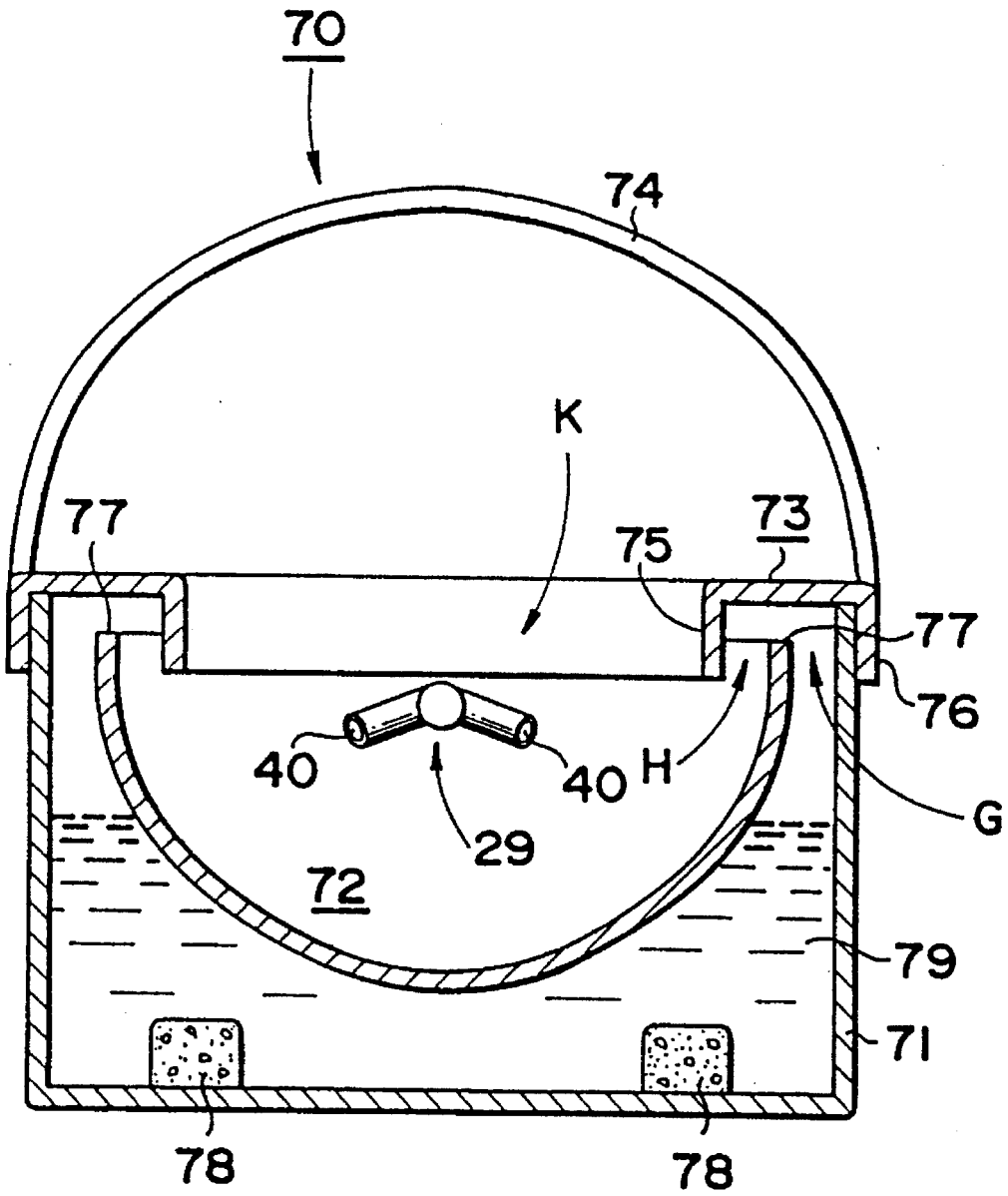
FIG. 10 is a cross-sectional view taken along line 10—10 of FIG. 9.
Figure 11:
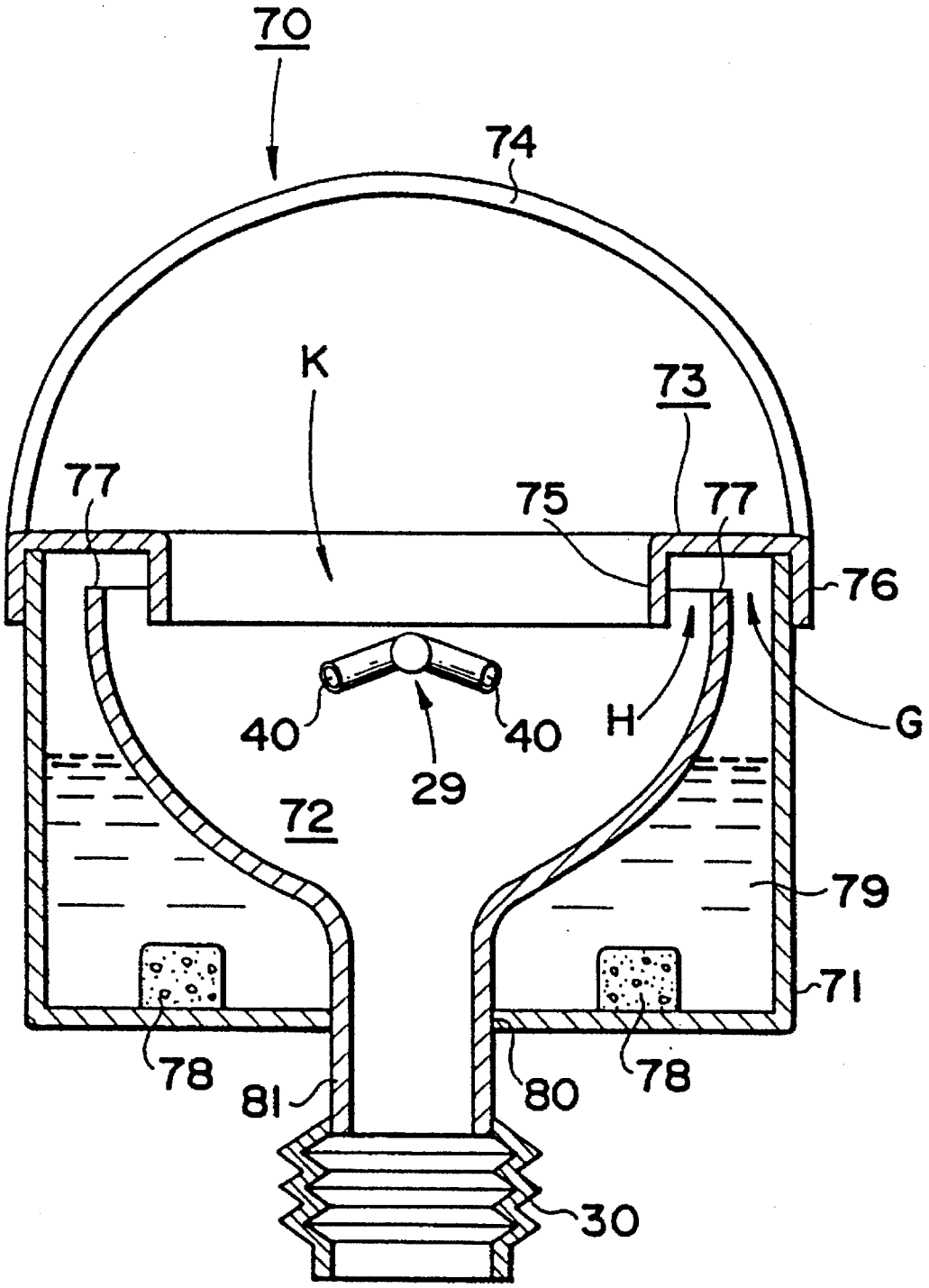
FIG. 11 is a cross-sectional view taken along line 11—11 of FIG. 9.
Figure 12:
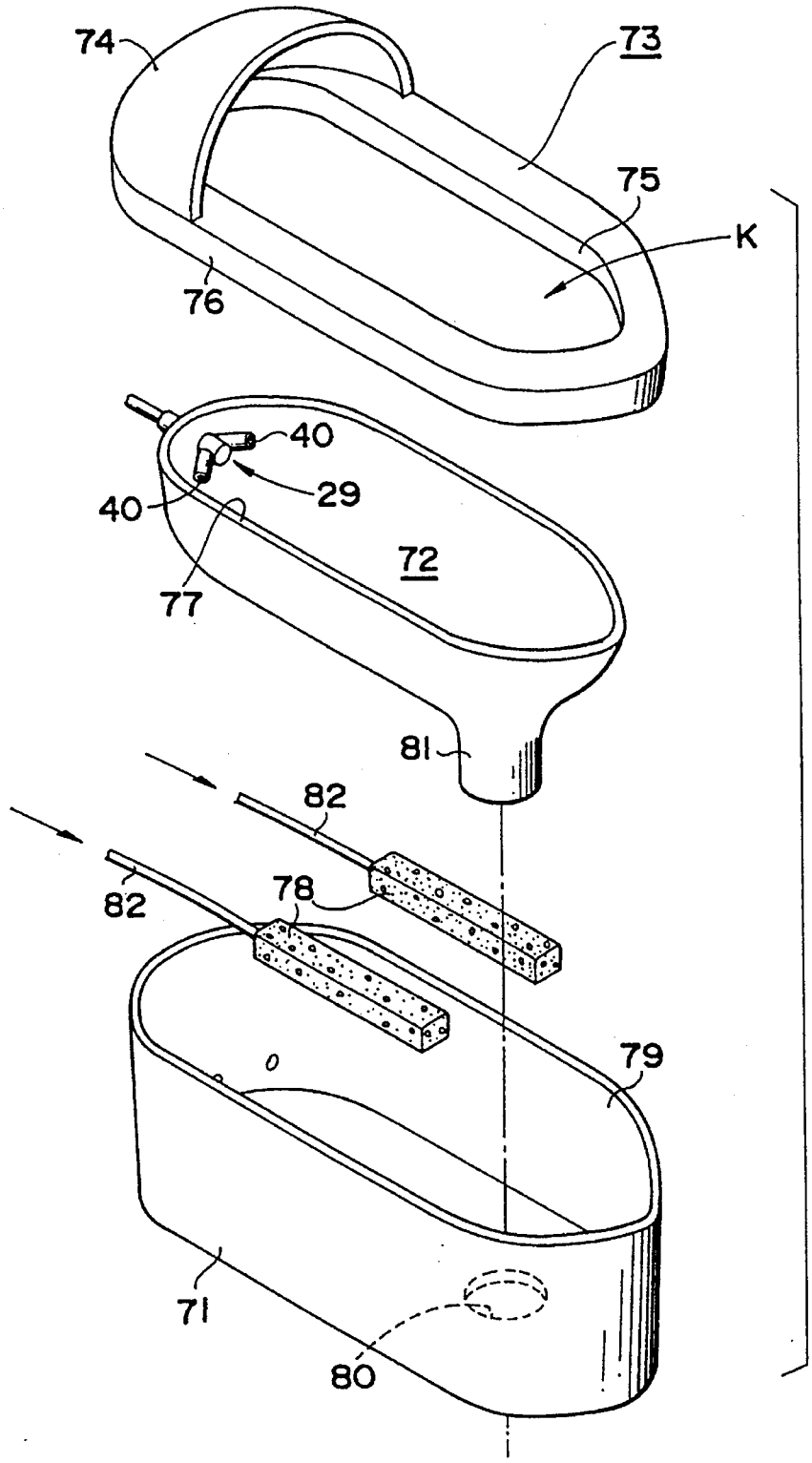
FIG. 12 is an exploded perspective view showing main constituents of the stool of FIG. 9.

Referring to FIGS. 10–12, the outer cover 71 is oval in plan view (FIG. 12) and has a bottom part so as to hold liquid therein. Air discharge bodies 78 made of a porous material such as a sponge are fixed to the left and right sides of the inner bottom part of the outer cover 71. Washing liquid 79 (i.e., water which is mixed with foaming material) is reserved inside the outer cover 71 to reach a given liquid level. The inner bowl 72 is semicircular in cross section as shown in FIG. 10, and is opened at the upper end to form a horizontal upper end peripheral edge 77 that is also oval in plan view.

The upper cover 73 has an internal shape which is the same as the external shape of the outer cover 71 so as to cover the upper edge of the outer cover 71. The upper cover 73 has the oval introduction hole K at the central portion thereof, an inner wall or rim 75 hanging downward around the introduction hole K, i.e., inside the upper cover 73, and an outer wall or rim 76 hanging downward at the outside of the upper cover 73. The inner shape of the outer wall 76 is formed to be substantially the same as the exterior shape of the outer cover 71. When the upper cover 73 covers the outer cover 71, the inside of the outer wall 76 is brought into contact with the upper end periphery of the outer cover 71 and they are fixed to each other by adhesive agent, etc. The inner wall 75 hangs downward so as to form the introduction hole K. The upper cover 73 forms an oval annular space having a U-shaped cross section between the periphery of the inner and outer walls 75 and 76. The upper end peripheral edge 77 of the inner bowl 72 is positioned between the walls 75 and 76 and is spaced from the lower surface of the upper cover 73. In such a manner, the annular space under the upper cover 73 is partitioned to form an E-shaped cross section by the outer cover 71, upper cover 73 and inner bowl 72, thereby forming a passage G between the inside of the outer cover 71 and upper end peripheral edge 77 and a passage H between the inner wall of the inner wall 75 and the upper end peripheral edge 77.

A cylindrical discharge pipe 81 (FIG. 11) is integrally connected to the rear lower central portion of the inner bowl 72. The discharge pipe 81 is inserted downward through a circular opening 80 defined at the bottom part of the outer cover 71 and the lower end of the discharge pipe 81 is positioned lower than the bottom part of the outer cover 71. The opening 80 and discharge pipe 81 are brought into contact with and fixed to each other by adhesive agent so as to prevent leakage of liquid. The joint 30 is connected to the lower end opening of the discharge pipe 81.

As shown in FIG. 12, when disposing of raw sewage using the stool 70, air under pressure is supplied through air supply pipes 82 to the air discharge bodies 78. The air under pressure is spouted from the minute gaps or openings in the air discharge bodies 78 for forming fine air bubbles. When the air bubbles rise to the surface of the washing liquid 79 from the air discharge bodies 78, they bubble or agitate the washing liquid 79. Accordingly, fine bubbles are generated by the foaming material mixed with the washing water and they are heaped up on the surface of the washing liquid 79 and fill the chamber between the inside of the outer cover 71 and the outside of the inner bowl 72. When the height of the air bubbles is increased, they flow through the passage G and flow into the inner wall of the outer cover 71 through the passage H. As mentioned above, since the inner bowl 72 is spaced from the outer cover 71 and upper cover 73 and the upper end peripheral edge 77 is positioned horizontally, the air bubbles which flow over the upper end peripheral edge 77 flow uniformly to the entire periphery of the oval inner bowl 72 so that the inner wall of the inner bowl 72 is wrapped in the bubbles generated in the washing liquid 79.

When the user discharges the raw sewage toward the inner bowl 72 in a state where the entire surface of the inner wall of the inner bowl 72 is covered with the bubbles, the raw sewage contacts the bubbles stuck to the inner wall of the inner bowl 72 so that the raw sewage does not directly contact the inner bowl 72, and hence the inner bowl 72 is not dirtied by the raw sewage. After the discharge of the raw sewage by the user, the cleaning liquid is jetted from the nozzles 40 of the ejector 29. Since the raw sewage tends to float due to the bubbles, it flows smoothly toward the discharge pipe 81 and is finally introduced into the raw sewage disposal apparatus (such as apparatus 15 of FIG. 1) through the joint 30. When the cleaning liquid is jetted from the nozzles 40, the toilet paper or foreign matter, which falls down and may be stuck to the inner bowl 72, is flushed together with the raw sewage toward the raw sewage disposal apparatus due to the fluidity of the bubbles.

With the arrangement of the present invention, the surface of the inner bowl of the stool can be wrapped in the air bubbles by a simple mechanism. Further, since the raw sewage discharged toward the inner bowl is wrapped in the bubbles, it does not normally directly contact the inner bowl so that the inner bowl is not dirtied by the raw sewage.

Since the raw sewage floats in or on the cleaning liquid by the lubricatory bubbles, the fluidity of the raw sewage can be increased so that it can be flushed easily by the cleaning liquid when it is jetted from the nozzles. Still further, since not only the raw sewage but also the toilet paper or foreign matter can be flushed by a light force due to the fluidity of the bubbles, such foreign matter other than the raw sewage can also be discharged toward the raw sewage disposal apparatus, thereby always keeping the stool clean.

Although a particular preferred embodiment of the invention has been disclosed in detail for illustrative purposes, it will be recognized that variations or modifications of the disclosed apparatus, including the rearrangement of parts, lie within the scope of the present invention.

What is claimed is:

1. A stool containing a cleaning mechanism comprising:

an outer cover having a bottom part and an upper opening;

an inner bowl accommodated inside said outer cover for receiving raw sewage therein, said inner bowl being spaced from said outer cover to define a space therebetween;

said inner bowl including ejector means having at least one nozzle for jetting a flow of cleaning liquid along an inner periphery of said inner bowl to remove raw sewage therefrom;

a substantially ring-shaped upper cover having an inner peripheral surface which is disposed about an upper end of said outer cover, a lower surface which is spaced from an upper end peripheral edge of said inner bowl, and a central introduction hole through which raw sewage is introduced into said inner bowl, wherein cleaning liquid is interposed in the space between said outer cover and said inner bowl, said cleaning liquid being cleaning water mixed with a foaming material;

a liquid storage means containing said cleaning liquid, said space and said ejector means being in communication with said liquid storage means for receiving said cleaning liquid therefrom; and an air discharge body provided inside said bottom part of said outer cover for receiving air supplied from outside and for spouting said air therefrom.

2. A toilet stool according to claim 1, wherein said upper cover has an inner wall, which hangs along an inner edge of said introduction hole and is spaced from said upper end peripheral edge of said inner bowl, and an outer wall in an annular shape which is continuous with said inner wall and defines said inner peripheral surface so as to surround said upper end peripheral edge of said inner bowl.

3. A toilet stool according to claim 1, further including a supply pipe for supplying said cleaning liquid into the space between said outer cover and said inner bowl, and a liquid discharge pipe for discharging said cleaning liquid outside said outer cover when said cleaning liquid overflows a given liquid level, said supply pipe and said discharge pipe being in communication with said liquid storage means.

4. A toilet stool according to claim 1, wherein said inner periphery of said inner bowl includes opposing first and second sides, said at least one nozzle being disposed on said first side of said inner bowl and oriented so as to jet said flow sidewardly along said inner periphery toward said second side.

5. A toilet stool according to claim 1, wherein said nozzle projects into a raw sewage-receiving interior of the inner bowl and extends through and mounts to said inner bowl.

6. Self-cleaning toilet stool comprising:

an outer cover having a bottom part and an upper opening;

an inner bowl accommodated inside said outer cover for receiving raw sewage therein, said inner bowl being spaced from said outer cover to define a space therebetween;

a substantially ring-shaped upper cover having an inner peripheral surface which is disposed about an upper end of said outer cover, a lower surface which is spaced from an upper end peripheral edge of said inner bowl, and a central introduction hole through which raw sewage is introduced into said inner bowl, wherein cleaning liquid is interposed in the space between said outer cover and said inner bowl, said cleaning liquid being cleaning water mixed with a foaming material;

at least one air discharge body provided inside said bottom part of said outer cover for receiving air supplied from outside and for spouting said air therefrom;

a supply pipe in communication with the space between said outer cover and said inner bowl for supplying said cleaning liquid therein; and a liquid discharge pipe in communication with the space for discharging said cleaning liquid outside said outside cover when said cleaning liquid overflows a given liquid level.

7. A toilet stool according to claim 6, wherein said inner bowl has a bottom part which extends downward beyond said bottom part of said outer cover and is connected to a stool discharge pipe through which the raw sewage flows.

8. A toilet stool according to claim 6, wherein said upper cover has an inner wall which hangs along an inner edge of said introduction hole and is spaced from said upper end peripheral edge of said inner bowl and which is continuous with an outer wall in an annular shape so as to surround said upper end peripheral edge of said inner bowl.

9. A toilet stool according to claim 8, wherein said inner bowl has an ejector having at least one nozzle for jetting cleaning liquid along an inner periphery of said inner bowl.

10. A toilet stool according to claim 9, wherein said inner bowl has a bottom part which extends downward beyond said bottom part of said outer cover and is connected to a stool discharge pipe through which the raw sewage flows.

11. A toilet stool according to claim 6, wherein said inner bowl has an ejector having at least one nozzle for jetting cleaning liquid along an inner periphery of said inner bowl.

12. A toilet stool according to claim 6, wherein:

said outer cover is substantially oval, and;

said inner bowl is substantially oval and is accommodated inside said outer cover.

13. In a self-cleaning toilet stool comprising:

an inner bowl having an inner annular wall defining a chamber for receiving waste, said inner bowl having an upper opening communicating with said chamber, and a drain pipe in communication with said chamber and projecting downwardly therefrom;

an outer shell for generally enclosing said inner bowl, said outer shell including an outer cover which surrounds said inner bowl and includes a bottom wall which is sealed relative to said inner bowl;

said inner bowl and said outer cover defining an annular space therebetween for containing a quantity of a bubble-producing cleaning liquid;

said outer shell including a ring-shaped top cover fixed to said outer cover and projecting radially inwardly over an upper peripheral edge of said inner bowl, said top cover defining a central opening therethrough in communication with the chamber in said inner bowl;

said top cover including a top wall which is spaced upwardly from said upper peripheral edge to define an unobstructed annular channel therebetween which provides communication between said annular space and said chamber;

a supply pipe connected to said outer shell for supplying cleaning liquid to said annular space;

an overflow pipe connected to said outer shell for removing excess cleaning liquid from said annular space when the cleaning liquid exceeds a predetermined level; and a member disposed within said annular space for ejecting air into said space to cause bubbling of the cleaning liquid within said space, and an air supply device connected to said member for supplying pressurized air thereto;

whereby the air supplied to said space causes bubbling of the cleaning liquid so that bubbles fill said space and flow through said annular channel and then downwardly so as to cover the inner wall of said bowl with bubbles.

14. A toilet stool according to claim 13, wherein the top cover includes an inner annular wall which is fixed to an inner peripheral edge of the top wall and projects downwardly a limited extent, said inner annular wall defining said opening and being spaced radially inwardly from said bowl to define an unobstructed annular passage therebetween which communicates with said annular channel.

15. A toilet stool according to claim 13, including a nozzlelike ejector mounted on said inner bowl adjacent an upper edge thereof for discharging cleaning liquid along the inner wall of the bowl.

16. A toilet stool according to claim 13, wherein the member comprises a blocklike element of porous material which permits air to pass therethrough so as to discharge therefrom as fine bubbles.

17. A toilet stool according to claim 16, wherein the top cover defines a seat for the stool.

18. A toilet stool according to claim 16, wherein the top cover includes an inner annular wall which is fixed to an inner peripheral edge of the top wall and projects downwardly a limited extent, said inner annular wall defining said opening and being spaced radially inwardly from said bowl to define an unobstructed annular passage therebetween which communicates with said annular channel.

19. A toilet stool according to claim 18, including a nozzlelike ejector mounted on said inner bowl adjacent an upper edge thereof for discharging cleaning liquid along the inner wall of the bowl.

* * * * *